US006857330B2

(12) United States Patent
Murphy et al.

(10) Patent No.: US 6,857,330 B2
(45) Date of Patent: Feb. 22, 2005

(54) APPARATUS AND METHODS FOR AUTOMATICALLY INSPECTING DOVETAILS ON TURBINE ROTORS

(75) Inventors: Thomas Francis Murphy, Scotia, NY (US); Robert Martin Roney, Jr., Schoharie, NY (US); Robert L'Heureux, Val-Belair (CA); Denis Labrecque, St-Gervais (CA)

(73) Assignee: General Electric Company, Schenectady, NY (US)

( * ) Notice: Subject to any disclaimer, the term of this patent is extended or adjusted under 35 U.S.C. 154(b) by 204 days.

(21) Appl. No.: 10/158,230

(22) Filed: May 31, 2002

(65) Prior Publication Data

US 2003/0221497 A1 Dec. 4, 2003

(51) Int. Cl.[7] ..... G01M 19/00
(52) U.S. Cl. ..... 73/865.8
(58) Field of Search ..... 73/865.8, 866.5, 73/118.1; 417/63; 416/61; 415/118

(56) References Cited

U.S. PATENT DOCUMENTS 5,105,658 A * 4/1992 Jaafar et al. ..... 73/865.8
5,623,107 A 4/1997 Patterson, Sr. et al.

* cited by examiner

*Primary Examiner*—Robert Raevis
(74) *Attorney, Agent, or Firm*—Nixon & Vanderhye

(57) ABSTRACT

A scanner assembly for dovetail inspection of the wheels of a turbine rotor includes a series of circumferentially pivotally connected links: a motor link, transmission links, an encoder link, an adjustable link, free links and a base link mounting a transducer. The motor link mounts a motor for driving rollers on the transmission links and rotating the scanner assembly about the rotor shaft. The encoder link mounts an encoder for determining the circumferential position of the transducer about the shaft. The adjustable link enables the assembly to be tightened or loosened about the rotor shaft. The free links and base link complete the circular scanner assembly about the shaft. A single scan for a full 360° investigates the plurality of hooks on the side of the wheel opposite the transducer.

19 Claims, 7 Drawing Sheets

APPARATUS AND METHODS FOR AUTOMATICALLY INSPECTING DOVETAILS ON TURBINE ROTORS

BACKGROUND OF THE INVENTION

The present invention relates to apparatus and methods for automatically inspecting dovetails on turbine rotors without rotating the turbine rotor and particularly relates to an inspection system having a link system rotatably mounted about a rotor shaft and carrying a transducer for determining defects in the dovetails of the rotor wheels.

Currently, defects in the dovetails of rotors, e.g., tangential entry dovetails on steam turbine rotor wheels, are detected by manually moving an ultrasonic transducer about a stationary wheel on the turbine rotor shaft to interrogate the dovetail. The transducer is held in place by a rigid fixture which helps to keep it at a constant radial position. For each area of the dovetail geometry being inspected, one scan about the rotor is completed with the transducer held at a predetermined radial position. Proper radial positioning of the transducer on the face of the wheel is critical to assure the intended inspection area is being examined. This manual method disadvantageously requires the operator to be manually manipulating the transducer while observing a CRT display for signals indicative of defects.

An alternative method for identifying defects is to use a phased array and automated ultrasonic transducer (UT) dovetail inspection system. Such systems include an encoder feedback into a computer to collect the information needed to perform the test. The test, however, requires the turbine rotor to be placed on rollers or rolling devices so that the rotor may be turned for the inspection. Phased-array automated UT dovetail inspection systems of that type are not cost-effective for smaller units and require substantial labor and time to set up and perform the automated inspection.

Another prior inspection system is described and illustrated in U.S. Pat. No. 5,623,107. In that system, an inspection device having electric motor-driven magnetic wheels for magnetic attachment of the device to the cylindrical surface between the wheels of the turbine rotor is disclosed. While this system offered certain advantages, the complexity of set-up, the test time and maintenance of the system inhibited widespread adoption and use of such system.

BRIEF DESCRIPTION OF THE INVENTION

In accordance with a preferred embodiment of the present invention, there is provided an automated system, i.e., a scanner assembly for inspecting the dovetails of a turbine rotor without the need for rotating the rotor. To accomplish the foregoing, the scanner assembly includes an annular body or assemblage for encompassing the shaft of the rotor. The annular body has one or more traction devices for engaging the rotor shaft, as well as a drive for engaging the traction devices to rotate the body about the rotor shaft. A transducer is carried by the body for rotation therewith to enable the transducer to scan the dovetail of the rotor shaft wheel as the body rotates about the rotor shaft. Particularly, the annular body comprises a plurality of links pivotally coupled to one another at opposite ends to form a closed annular assembly. At least one of the links carries a motor in driving assembly with one or more rollers for rotating or driving the assembly about the shaft. Preferably, a pair of rollers are provided on transmission links in driving engagement through appropriate gearing with gearing carried by the drive motor link. An adjustable link includes a pair of arms connected at first ends to adjacent links and pivoted to one another at opposite ends at a location outside the circumference of the scanner assembly about the rotor shaft.

The pair of links are adjustable relative to one another to adjust the tension of all of the links about the rotor shaft. Further, one of the links carries an encoder for determining the circumferential position of a transducer carried on a mast or cassette mounted on another of the links. Consequently, the motor link in conjunction with the transmission links rotate the scanner 360° about the rotor shaft, with the encoder enabling positional feedback to a computer, thus enabling ultrasonic inspection of the dovetail region of the rotor without rotation of the rotor per se.

In a preferred embodiment according to the present invention, there is provided a system for automated inspection of dovetails of a turbine rotor, comprising an annular body for releasably encompassing a shaft of a turbine rotor and having a traction device for engaging the rotor shaft, a drive coupled to the traction device to rotate the body about the rotor shaft and a transducer carried by the body for rotation therewith enabling the transducer to scan a dovetail of the rotor as the body rotates about the rotor shaft.

In a further preferred embodiment according to the present invention, there is provided a method for automatically scanning the dovetails of a turbine rotor without rotation of the rotor, comprising the steps of mounting an annular body including a plurality of links pivoted to one another in a closed loop about the rotor, providing a transducer on one of the links for scanning the dovetail at a predetermined radial location outwardly of the rotor and rotating the annular body about the shaft to scan the dovetail.

DETAILED DESCRIPTION OF THE INVENTION

Figure 1:
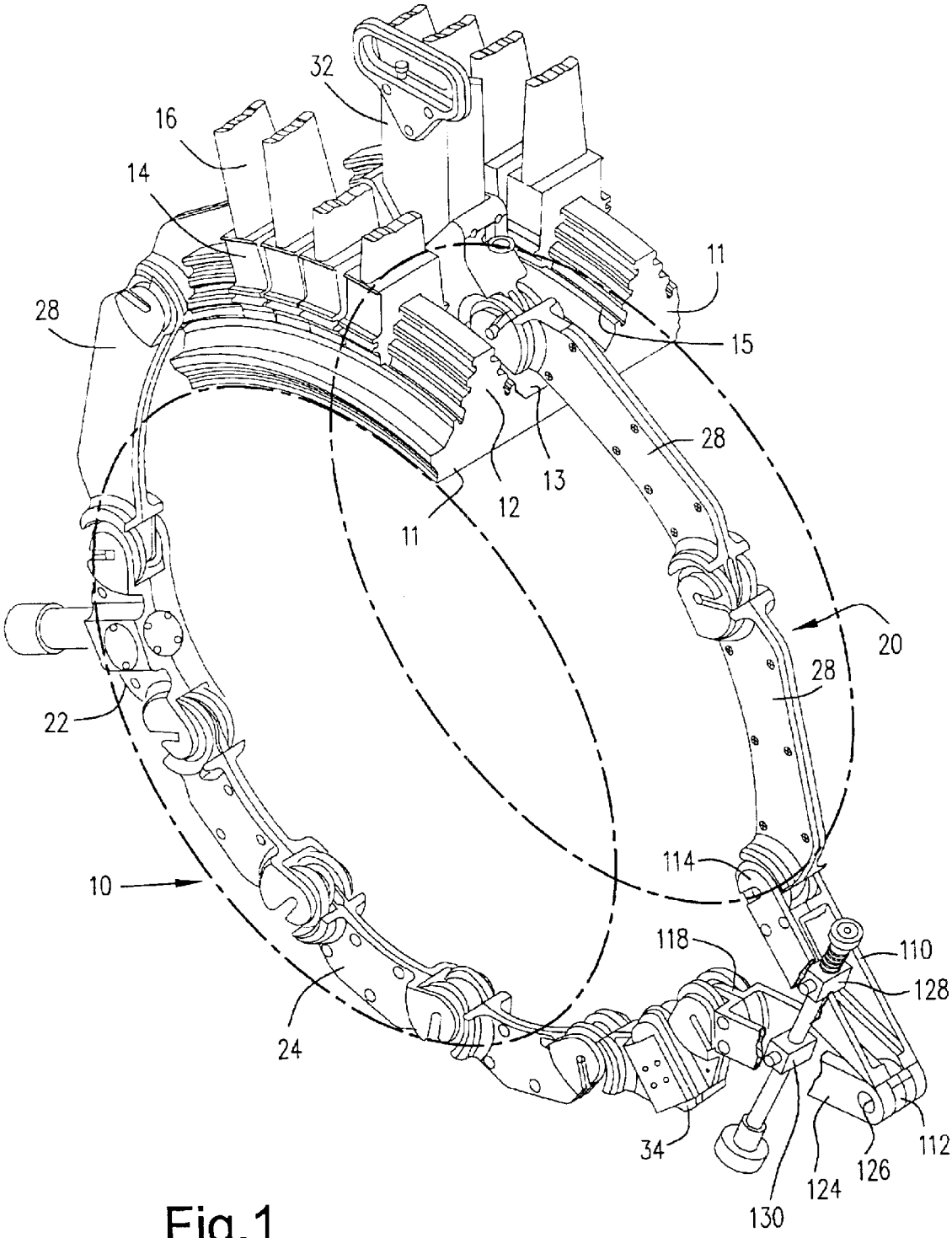
FIG. 1 is a fragmentary perspective view of a scanner assembly for ultrasonic dovetail inspection according to the present invention disposed about a fixed rotor shaft, only a portion of the shaft being illustrated.

Referring now to FIG. 1, there is illustrated a rotor shaft, generally designated 10, for a turbine, the rotor shaft 10 in part being indicated by the dot/dashed lines. The rotor carries a pair of rotor wheels 11 having annular radially outwardly projecting male dovetails 12 which receive the female dovetails 14 of a plurality of turbine blades 16 disposed in an annular array about the rotor wheels 11. It will be appreciated that there is a recessed cylindrical surface 13 radially inwardly of the bucket tang 15 and between the dovetails 12 on the rotor wheels. The transducer of the scanner assembly, generally designated 20, is disposed in the recessed space 13 between the wheels 11 as apparent from the ensuing description. It will be appreciated that while the female dovetails of multiple blades 16 of the turbine stages are illustrated, the scanner is utilized to scan the rotor wheel male dovetail 12 about the rotor shaft.

Figure 2:
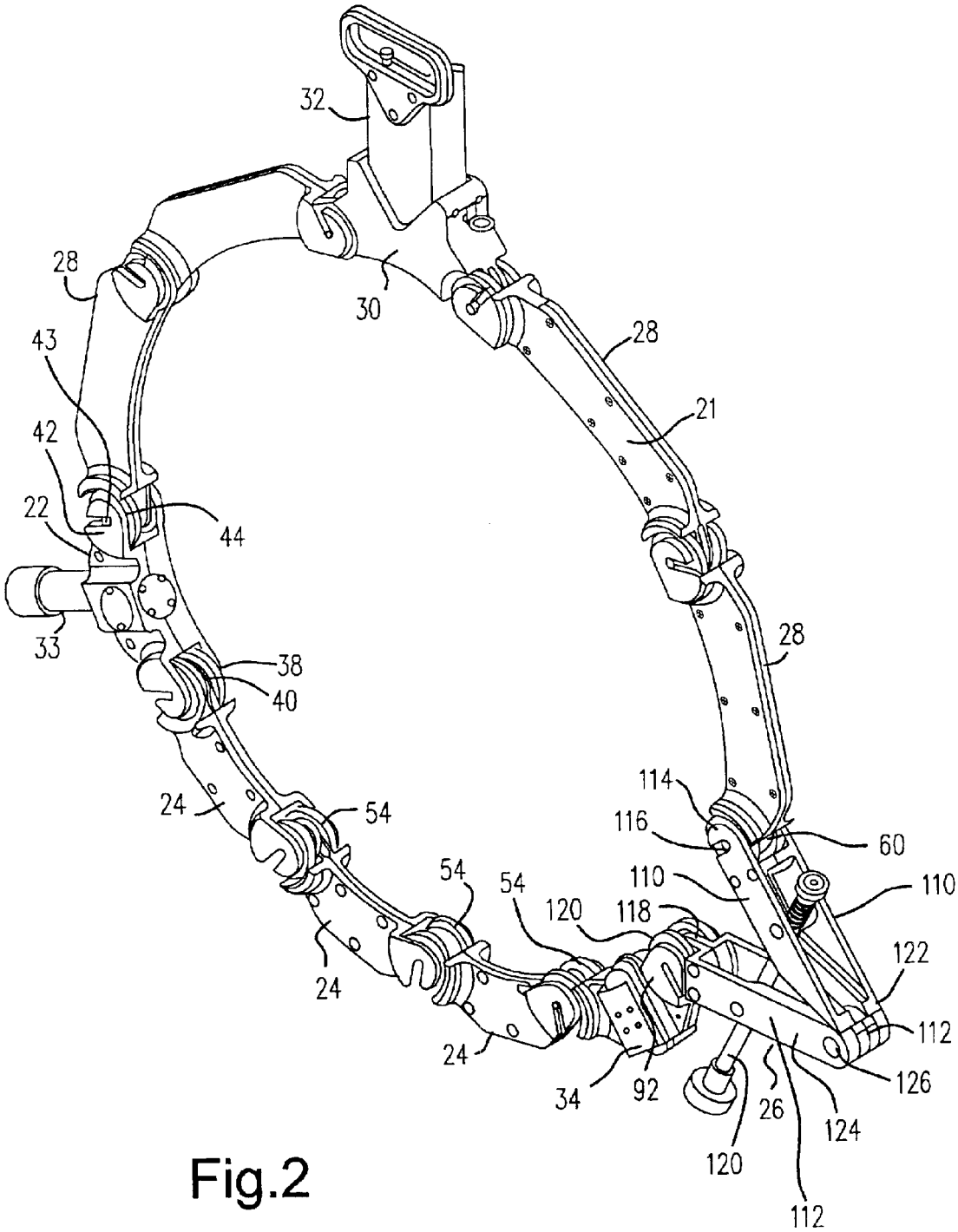
FIG. 2 is a perspective view similar to FIG. 1 of the scanner assembly without the rotor shaft.
Figure 3:
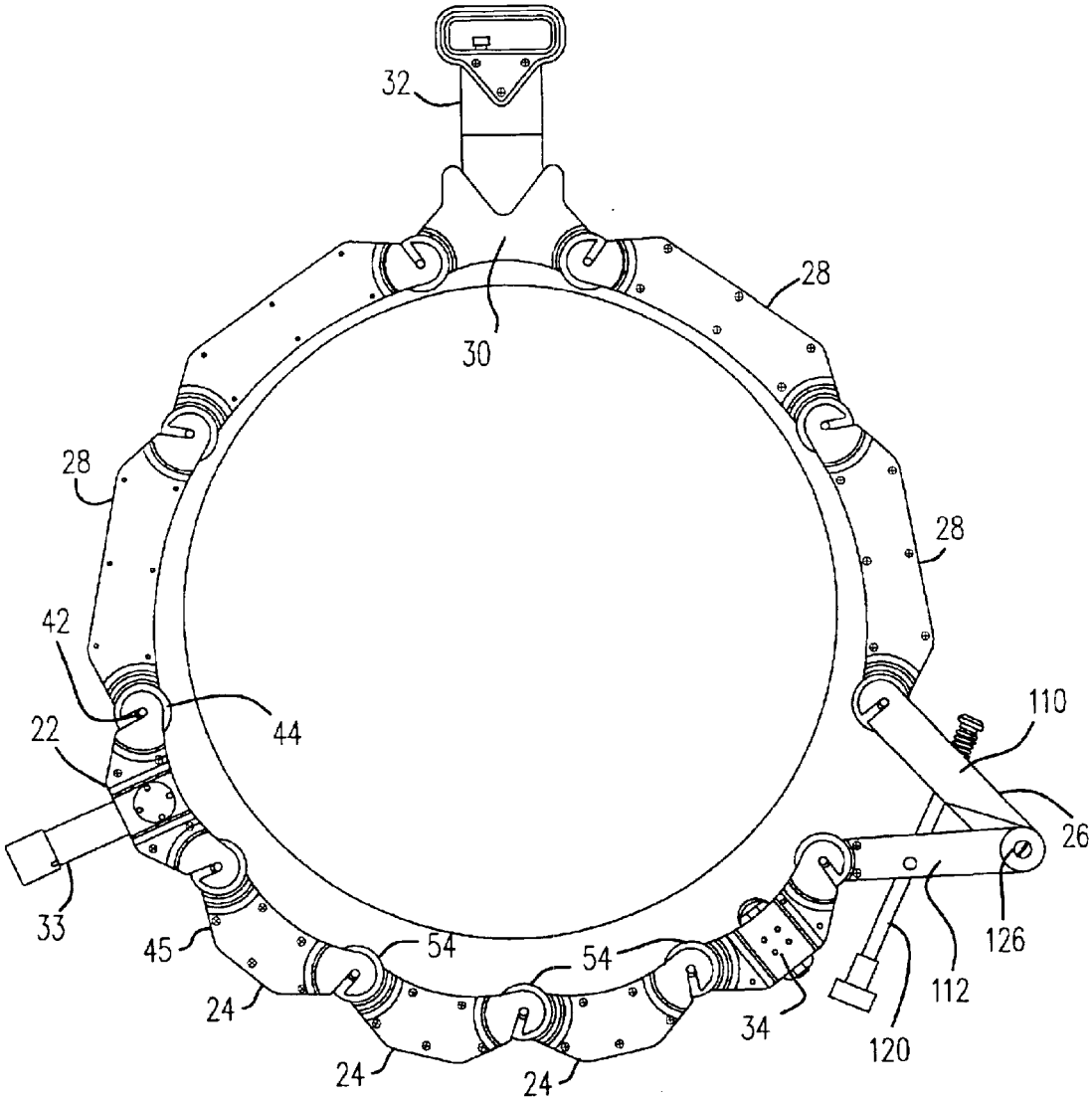
FIG. 3 is a front elevational view of the scanner assembly hereof and illustrated with parts broken out for clarity.

Referring particularly to FIGS. 1 and 2, the scanner assembly 20 includes an annular body 21 (FIG. 2) comprised of an assemblage of a number of different links: a motor link 22, transmission links 24, an adjustable link 26, free links 28, a base link 30 for carrying a transducer cassette or mast 32 and an encoder link 34. It will be appreciated that the scanner assembly 20 is rotated about the stationary rotor shaft 10, enabling the transducer carried by the mast 32 for full 360° rotation and inspection of a rotor wheel dovetail 12. The number of links required to locate scanner assembly 20 on the rotor shaft 10 is a function of the diameter of the rotor shaft and the surface condition of the shaft between the rotor wheels 11 or on other parts of the rotor. Thus, one or more additional transmission or free links can be provided as necessary to provide the scanner assembly with the appropriate diameter. Fine adjustments of the diameter of the scanner assembly are provided by the adjustment link 26, in a manner discussed below.

Figure 4:
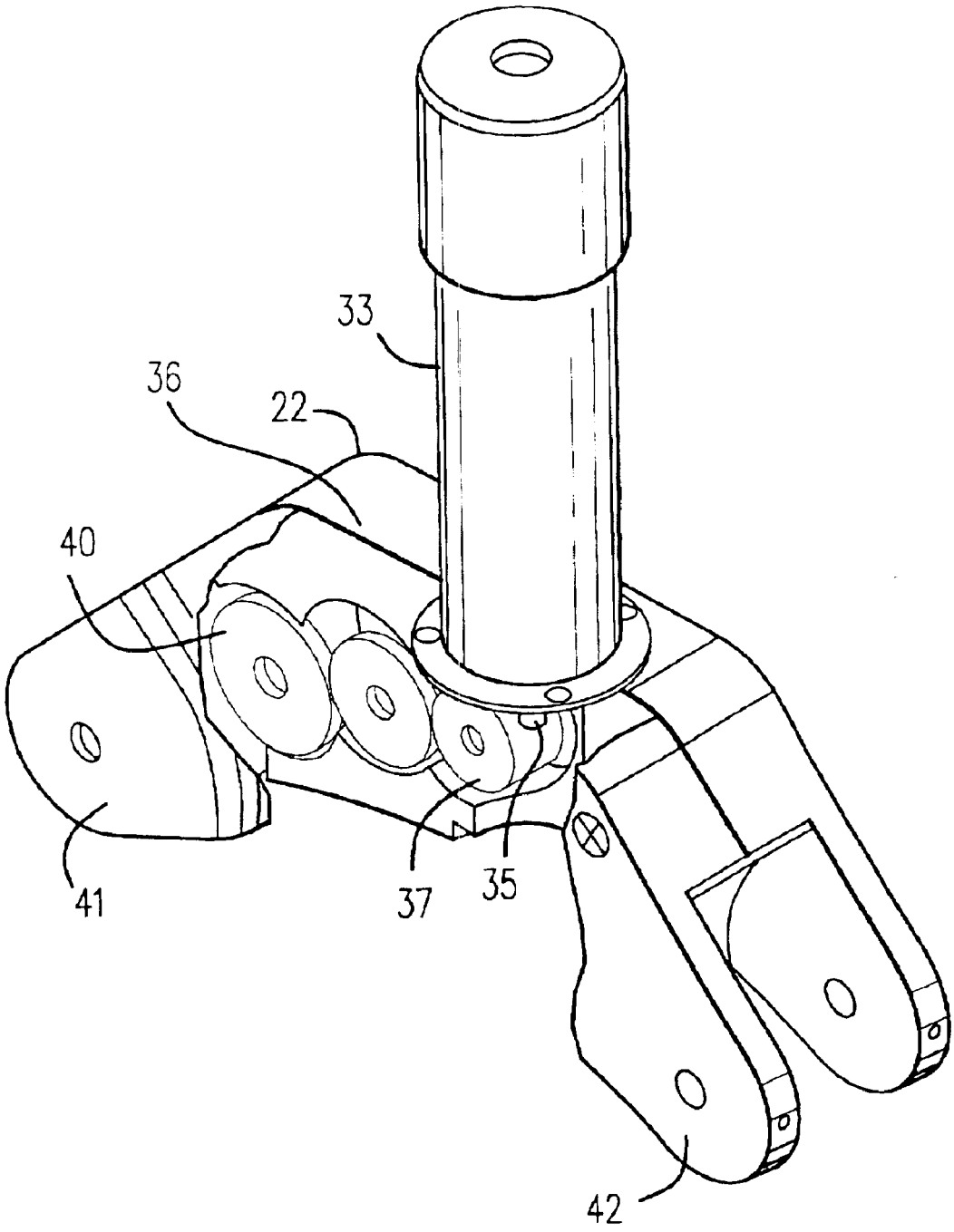
FIG. 4 is an exploded perspective view of a motor link for use in the scanner assembly.

Each of the links includes a roller at one end of the link, which is coupled to an opposite end of a circumferentially adjacent link. Thus, referring to FIG. 4, there is illustrated a motor link 22 comprised of a motor 33, preferably an electric motor, having a drive shaft 35 and gearing 37 located within the motor link housing 36 for driving a gear 40 at one end of the motor link 22 between support arms 41. Thus, it will be appreciated that by actuation of motor 33, gear 40 is rotated. The opposite end of the motor link 22 mounts a pair of support arms 42 for pivotally connecting with a wheel 44 (FIG. 2) of an adjacent free transmission link 24 about a common axle pin 43 (FIG. 2).

Figure 5:
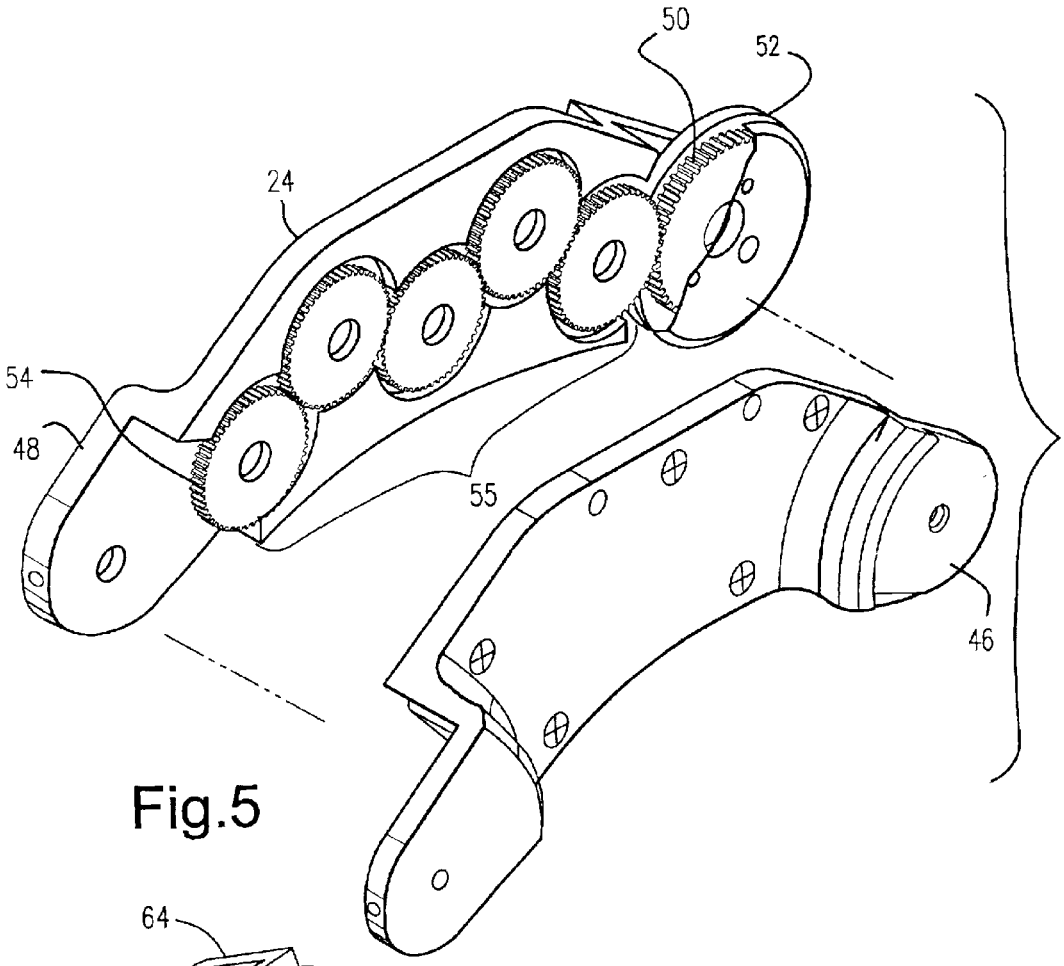
FIG. 5 is a perspective view of a transmission link for use in the scanner assembly.

A transmission link 24 is illustrated in FIG. 5 and in conjunction with the motor link provide a traction device 45 for engaging the rotor shaft and rotating the body 21 about the shaft. The transmission link 24 includes a pair of axially spaced support arms 46 and 48 at each of its opposite ends. The arms 46 are pivotally coupled between the support arms 41 on one end of motor link 22, with the motor link gear 40 in engagement with a transmission link gear 50. Paired wheels 52 also lie on a common axle with support arms 41 and 46 along with gear 50. The arms 48 at the opposite end of transmission link 24 receive paired wheels and gear of an adjacent link, for example, the wheels and gear of an additional transmission link 24. The transmission link 24 also includes an end gear 54 which engages with the gear 50 between the wheels 52 via a gear train 55 within the transmission link 24. The gear train 55 includes a series of drive gears between opposite ends of the transmission link 24 wherein the drive from the motor gear 40 is transmitted to gear 50 and through the drive train 55 of the transmission link 24 to drive the gear 54 at the opposite end and hence the gear and wheels of the next link.

As illustrated in FIG. 2, three transmission links 24 are illustrated whereby the drive from the motor link 22 is transmitted to gear 54 at the furthest end of the third transmission link 24 which is coupled with the encoder link 34. Consequently, it will be appreciated that the wheels 52 at each of the ends of the transmission links 24 nearest the motor link 22 drive the annular scanner assembly about the rotor shaft.

Figure 6:
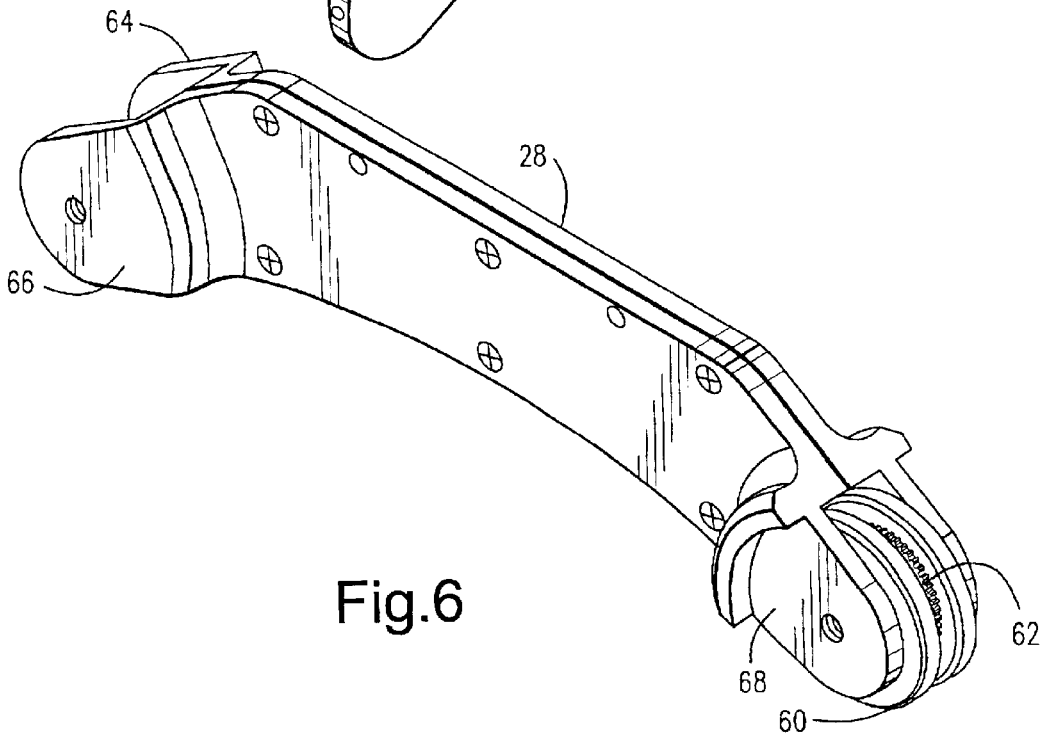
FIG. 6 is a perspective view of a free link for use in the scanner assembly.

Referring now to FIG. 6, there is illustrated a free link 28. Paired wheels 60 with a central gear 62 are rotatably disposed at one end of the free link 28 between spaced support arms 64 with axial openings for receiving axle pins to interconnect adjacent links. Spaced support arms 66 are disposed at the opposite end of free link 28. Thus, it will be appreciated that the end of the free link 28 mounting wheels 60 may be mounted between the support arms 42 of the motor link 22. The support arms 66 at the opposite end of the free link 28 straddles the arms 68 of an adjacent free link 28 whereby the free links may be connected one to the other.

Figure 7:
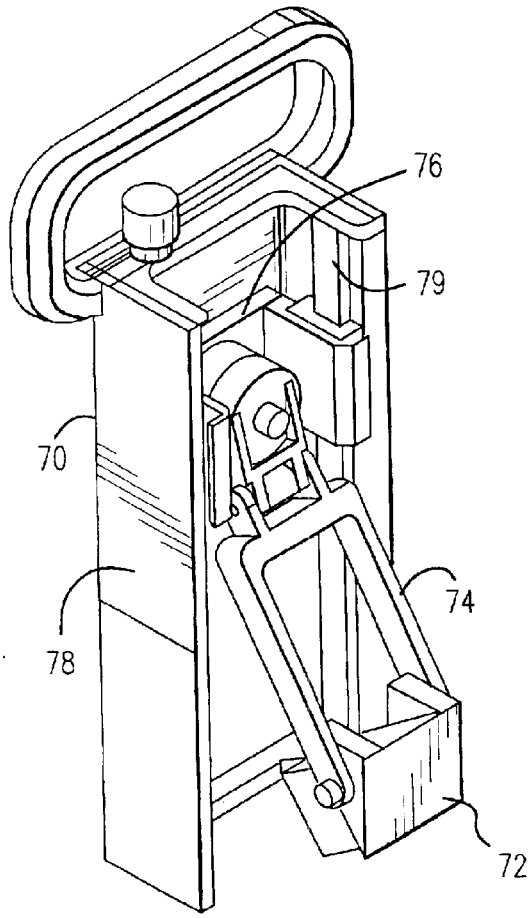
FIG. 7 is a perspective view of a mast for carrying the transducer.

Referring now to FIG. 7, there is illustrated a mast or cassette 70 for carrying the transducer 72. The transducer is mounted on a pivoted support member 74 carried by an inner housing 76 slidable in a radial direction along an outer housing 78. Thus, transducer 72 may be located at adjusted elevations relative to housing 78 and hence relative to the wheel dovetail when the scanner assembly is disposed about the rotor shaft. The slidable housing 76 slides in guideways 79 formed along the inside surfaces of the housing 78. The transducer may therefore be adjusted in a radial position by sliding the housing radially outwardly or inwardly and in an axial direction relative to the rotor toward and away from an adjacent wheel by pivoting arm support 74 relative to housing 70.

Figure 8:
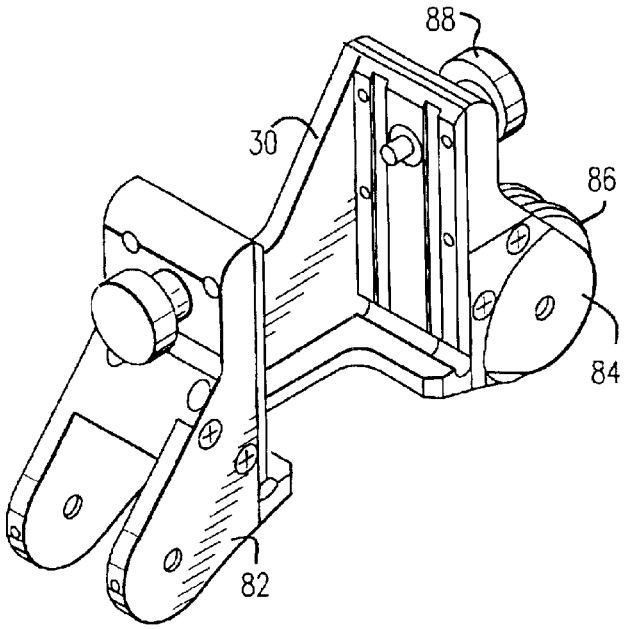
FIG. 8 is a perspective view of a base link for carrying the mast of FIG. 7.

The base link 30 in FIG. 8 includes spaced support arms 82 and 84 at opposite ends. The arms 82 straddle the wheels and support arms of an adjacent link, for example, the support arms 68 of a free link 28. The support arms 84 may be pivoted between the support arms 66 of another adjacent free link 28. Thus, the base link 30 and free links 28 may be coupled one to the other, e.g., by axle pins inserted into the openings of the arms 82 and wheels. The support arms 84 of the base link 30 mounts paired rollers 86 and are straddled by the arms 64 of the adjacent free link 24. The transducer mast or cassette is disposed in and fixed to the base link 30. The mast 70 is received within opposite end walls of the base link 30 and is clamped therein by threaded knobs 88.

Figure 9:
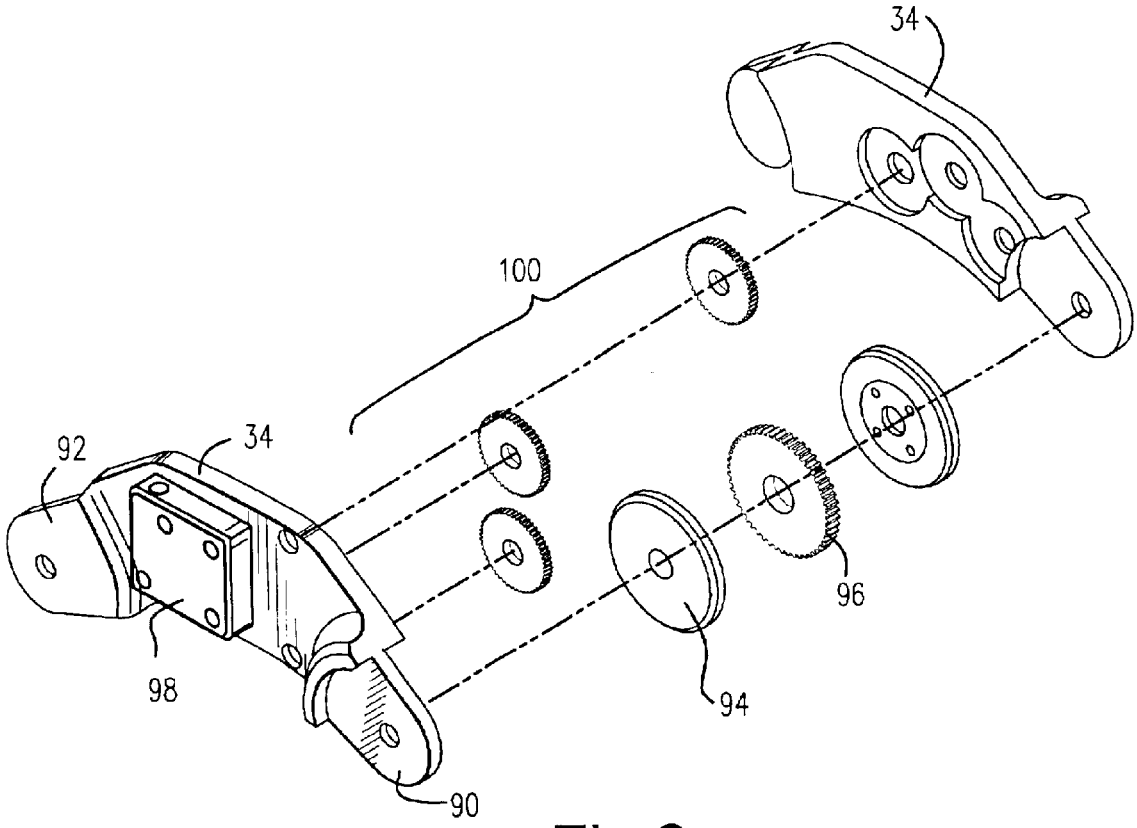
FIG. 9 is an exploded perspective view of an encoder link forming part of the scanner assembly hereof.

Referring to FIG. 9, the encoder link 34 similarly has the spaced arms 90 and 92 at opposite ends, respectively. The arms 92 pivotally carry paired wheels 94 with a gear 96 therebetween. Thus, arms 90, wheels 92 and gear 96 are received between arms 48 of an adjacent link, e.g., a transmission link 24 with gears 54 and 96 in engagement. Arms 92 receive the support arms and paired wheels of the adjacent adjustable link 26. The encoder link carries an encoder 98 which is driven by a gear train 100. The encoder allows positional feedback to a computer, not shown. The encoder reads the positional information transmitted from the wheels via the gear train 100 and feeds the information to the computer such that the location of the transducer about the rotor shaft is constantly known.

The adjustable link 26 completes the annular body or loop of the scanner assemblage about the rotor shaft and allows the scanner assembly to be tightened about the rotor shaft. The adjustable link 26 includes, as illustrated in FIGS. 1 and 2, pairs of links 110 and 112. The first ends 114 of links 110 straddle and are connected by axle pins 116 to the wheels of an adjacent free link 28. The first ends 118 of the pair of links 112 mount a pair of wheels 120, together with a gear between the wheels similarly as the transmission links 24. The arms 92 of the encoder link 34 straddle the wheels 120 and the gear 96. The second ends 122 and 124 of the links 90 and 92, respectively, are pivotally connected to one another by an axle pin 126. A pair of blocks 128 and 130 are pivotally mounted between the links of each pair of links 110 and 112 intermediate the first and second ends thereof. A rod 120, reversely threaded adjacent opposite ends, passes through threaded openings in each of the lugs. An adjusting knob at one end of rod 120 may be rotated to change the angulation between the pairs of links 110 and 112, i.e., the change the circumferential distance between ends 114 and 118 of the pairs of links 110 and 112 to tighten or loosen the annular body of the scanner assembly about the rotor shaft.

It will be appreciated that with the scanner assembly, assembled on the rotor shaft and tightened through the use of the adjustable link 26, is maintained firmly about the shaft. The scanner assembly interfaces with an external phased array computer and motion control system through a tethered cable, not shown, to provide ultrasonic inspection of the dovetail region of the rotor as the scanner assembly rotates about the rotor. The transducer 72 is positioned below the tang 15 of the rotor wheel dovetail. A refracted ultrasonic beam is directed radially outward toward the dovetail hooks on the side of the wheel 11 opposite the transducer 72. The full dovetail circumference of the wheel is scanned. Using a phased array dovetail inspection method, the transducer 72 may remain in one radial position while the ultrasonic beam is electronically steered through a selected range of angles at each circumferential position. Consequently, all hooks on one side of the wheel are inspected in a single 360° scan since the phased array enables electronic focus of the beam at each hook location. The beam is swept through the full dovetail volume in small angular increments, assuring complete volumetric coverage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for automated inspection of dovetails of a turbine rotor, comprising:

an annular body for releasably encompassing a shaft of a turbine rotor and having a traction device for engaging the rotor shaft;

a drive coupled to the traction device to rotate the body about the rotor shaft; and a transducer carried by said body for rotation therewith enabling the transducer to scan a dovetail of the rotor as the body rotates about the rotor shaft.

2. An inspection system according to claim 1 wherein said traction device includes a plurality of rollers carried by said body.

3. An inspection device according to claim 1 wherein said body includes a plurality of links pivotally coupled to one another, said traction device including at least one roller carried by one of said links and in driving engagement with said drive.

4. An inspection device according to claim 1 wherein said body includes a plurality of links pivotally coupled to one another, said traction device including a plurality of rollers, with each roller being rotatably carried by one of said links, said rollers being in driving engagement with one another.

5. An inspection device according to claim 4 wherein each said link carries one of said rollers at one end thereof, an opposite end of each said link being coupled to and supported by an adjacent link.

6. An inspection device according to claim 1 wherein said body includes a plurality of generally circumferentially aligned links pivotally coupled to one another for extending about the circumference of the rotor shaft and means for tensioning said links about the rotor shaft.

7. An inspection system according to claim 6 wherein said tensioning means includes a pair of adjacent links extending from opposite first ends in circumferential alignment with said plurality of links toward second ends thereof, said pair of adjacent links being pivotally coupled to one another at said second ends and located outwardly of the circumferentially aligned links, and a threaded rod coupled between said adjacent links for adjusting said adjacent links to draw said first ends thereof toward one another.

8. An inspection system according to claim 6 wherein said tensioning means include an adjusting device disposed between a pair of said links for adjusting the tension of said body about the rotor shaft.

9. An inspection system according to claim 1 wherein said body includes a plurality of links pivotally coupled to one another, one of said links carrying a radially outwardly projecting mast, said transducer being carried by said mast at a predetermined radial location about the shaft.

10. An inspection system according to claim 1 wherein said body includes a plurality of links pivotally coupled to one another, one of said links carrying an encoder for determining circumferential position of the body about the shaft.

11. An inspection system according to claim 1 wherein said body includes a plurality of links pivotally coupled to one another, said traction device including a plurality of rollers with each roller being rotatably carried by one of said links, each said link carrying one of said rollers at one end thereof, an opposite end of each said link being coupled to and supported by an adjacent link, a first of said plurality of links carrying a radially outwardly projecting mast, said transducer being carried by said mast at a predetermined radial location about the rotor, a second of said plurality of links carrying an encoder for determining the circumferential position of the body about the rotor, and an adjusting device interconnecting an adjacent pair of links for tensioning said plurality of links about said shaft.

12. A method for automatically scanning the dovetails of a turbine rotor without rotation of the rotor, comprising the steps of:

mounting an annular body including a plurality of links pivoted to one another in a closed loop about the rotor;

providing a transducer on one of said links for scanning the dovetail at a predetermined radial location outwardly of said rotor; and rotating the annular body about said shaft to scan the dovetail.

13. A method according to claim 12 including providing a drive motor on one of said links and driving the annular body about the shaft.

14. A method according to claim 12 including tensioning the links about the shaft.

15. A method according to claim 12 including providing an encoder on one of said links and determining the circumferential position of the annular body about the shaft using said encoder.

16. A method according to claim 12 including providing a drive motor on one of said links and drive rollers on a predetermined number of said links, interconnecting said drive rollers on said predetermined number of said links and driving said drive rollers using said drive motor on said on e link to rotate the body about the shaft.

17. A method according to claim 12 including providing a drive motor on one of said links and driving the annular body about the shaft, including tensioning the links about the shaft.

18. A method according to claim 12 including providing a drive motor on one of said links and driving the annular body about the shaft, including providing an encoder on one of said links and determining the circumferential position of the annular body about the shaft using said encoder.

19. A method according to claim 12 including tensioning the links about the shaft, including providing an encoder on one of said links and determining the circumferential position of the annular body about the shaft using said encoder.

* * * * *

UNITED STATES PATENT AND TRADEMARK OFFICE

CERTIFICATE OF CORRECTION

PATENT NO. : 6,857,330 B2
DATED : February 22, 2005
INVENTOR(S) : Murphy et al.

It is certified that error appears in the above-identified patent and that said Letters Patent is hereby corrected as shown below:

Column 6,
Lines 48-49, the words "on e" should read -- one --

Signed and Sealed this

Fifth Day of July, 2005

JON W. DUDAS
*Director of the United States Patent and Trademark Office*